US005921854A

United States Patent [19]

Evensen

[11] Patent Number: 5,921,854

[45] Date of Patent: Jul. 13, 1999

[54] METHOD AND APPARATUS FOR SANDING WITH A ROTATING ROLLER

[76] Inventor: Kenneth R. Evensen, 1429 Fremont Ave., Bartlett, Ill. 60103

[ * ] Notice: This patent is subject to a terminal disclaimer.

[21] Appl. No.: 08/817,495

[22] PCT Filed: Oct. 18, 1995

[86] PCT No.: PCT/US95/12863

§ 371 Date: Jul. 14, 1997

§ 102(e) Date: Jul. 14, 1997

[87] PCT Pub. No.: WO96/11771

PCT Pub. Date: Apr. 25, 1990

Related U.S. Application Data

[63] Continuation-in-part of application No. 08/409,863, Apr. 26, 1995, Pat. No. 5,567,197, which is a continuation-in-part of application No. 08/324,806, Aug. 18, 1994, Pat. No. 5,564,971, which is a continuation-in-part of application No. 08/168,042, Dec. 15, 1993, Pat. No. 5,365,628

[60] Provisional application No. 60/002,568, Aug. 21, 1995.

[51] Int. Cl.[6] ..... B24D 9/02

[52] U.S. Cl. ..... 451/504; 451/358; 451/506

[58] Field of Search ..... 451/344, 350, 451/352, 358, 495, 504, 506–509, 513, 514, 516, 526, 528, 538, 539

[56] References Cited

U.S. PATENT DOCUMENTS

| | | | |
|---|---|---|---|
| 1,325,937 | 12/1919 | Fox . | |
| 2,221,173 | 11/1940 | Gutsell . | |
| 2,483,422 | 10/1949 | Larson . | |
| 3,597,883 | 8/1971 | Choplin . | |
| 3,688,453 | 9/1972 | Legacy et al. . | |
| 3,790,980 | 2/1974 | Sylvie . | |
| 3,793,782 | 2/1974 | Bowling . | |
| 4,177,611 | 12/1979 | Carr-Rollett . | |
| 4,380,092 | 4/1983 | Brothers . | |
| 4,694,616 | 9/1987 | Lindberg . | |
| 5,007,208 | 4/1991 | Garfield . | |
| 5,380,239 | 1/1995 | Casillas et al. | 451/496 |

*Primary Examiner*—Eileen P. Morgan
*Attorney, Agent, or Firm*—Fitch, Even, Tabin & Flannery

[57] ABSTRACT

The roller and belt assembly for mounting on a spindle or drive shaft comprises a closed loop belt having an inner surface and an outer surface, the inner surface having an engaging material thereon, and the outer surface having an abrasive or bussing material thereon. The assembly further includes a cylindrical roller having an outer cylindrical surface, having a longitudinal axis and having a resilient, compressible material attached to and covering the outer cylindrical surface. Sliding and engaging structure is attached to the resilient, compressible material which, when the belt is rotated in the first direction, allows the belt to slidingly rotate around and about the longitudinal axis of the roller and, when the belt is rotated in a second direction, the sliding and engaging structure engages the engageable material on the inner surface of the belt and prevents the belt from rotating about the roller.

17 Claims, 11 Drawing Sheets

METHOD AND APPARATUS FOR SANDING WITH A ROTATING ROLLER

CROSS-REFERENCE TO RELATED APPLICATIONS

The present application is based on and claims the benefit of U.S. Provisional Application Ser. No. 60/002,568, filed Aug. 21, 1995, now abandoned. The present application is a continuation-in-part of U.S. patent application Ser. No. 08/409,863, filed Apr. 26, 1995, now U.S. Pat. No. 5,567,197, which is a continuation-in-part of U.S. patent application Ser. No. 08/324,806, filed Aug. 18, 1994, now U.S. Pat. No. 5,564,971, which is a continuation-in-part of U.S. patent application Ser. No. 08/168,042, filed Dec. 15, 1993, now U.S. Pat. No. 5,365,628.

BACKGROUND OF THE INVENTION

This invention relates to methods of and apparatus for sanding wood and other surfaces, and more particularly, to hand-held, motor power, electric or pneumatic sanding machines having a rotating roller.

Conventional rotary disk sanders and orbital sanders are used by millworkers, refinishers, cabinet makers, etc. to sand a smooth surface on pieces of wood. Typically, the rotary or orbital wood sanders with the rotating sanding material makes slight swirl marks or scratches that cut across the wood grain, and then these swirl marks must be removed by a hand-sanding and finishing of the wood surface with the grain. The surface area of these hand-held disks is usually small. One factor in limiting the effectiveness of the sanding disk is that outer edges move at higher speeds and sometimes make deep scratches, particularly, across the grain of the wood.

A number of prior art sanding devices have been disclosed in patents such as U.S. Pat. Nos. 3,793,782; 1,325,937; 3,790,980; 4,692,958; 4,380,092; 4,177,611; 4,694,616; and 5,007,208 using various motors and rotatable rollers or the like which have not been able, for one reason or another, to provide the market with a commercially available, hand-held, motor-driven tool. These roller sanders have been unable to replace conventional belt sanders or the orbital or rotary disk sanders that have most of the wood finishing market between themselves. There is on the market a wheeled sander that has a rotating sanding roller that is wheeled linearly along the wood grain. The wheels are a limiting factor where one can use this machine. Another sander on the market is called a stroke sander and has a sanding surface about six (6) inches wide and is used with a table eight (8) to ten (10) feet in length. Typically, this stroke sander is expensive, e.g., about $3,000, relatively the cost of a hand tool sander. Another sander requiring a large area is called a wide belt sander that has a belt stretched between a pair of drums. A drive drum rotates the belt, and a platen is positioned between the upper and lower runs of the endless sanding belt and pushes down on the inner surface of the lower belt run to force the outer sanding surface against the wood to sand the same. Typically, these wide, belt sanders have tables two (2) feet to five (5) feet in width and cost, for the smallest size, about $6,000. Manifestly, these large table sanders cannot be turned on edge to sand the faces or edges of a piece of wood, furniture or the like as can hand-held sanders. Belts on both the wide belt and stroke sander are relatively expensive.

Thus, there is a need for an improved, hand-held, inexpensive sanding tool having a rotatable roller that can be used for in-line sanding and that permits sanding without digging into the wood or other surfaces or without leaving swirl marks that are made by the commonly used, hand-held orbital or rotary sanders. Also, there is a need for a faster sanding method than is current provided with small, hand-held, rotary sanding equipment.

There is also a need for new and improved ways of detachably mounting a cylindrical sanding sleeve onto the rotatable roller so that the sanding sleeves may be readily attached or detached. Also, cylindrical sanding sleeves are relatively bulky for storage and for shipping. Thus, there is a need for a flat sanding sheet that may be erected into a cylindrical sleeve and used without a seam that scores or scratches the substrate being sanded. Also, shipping a flat sandpaper sleeve guarantees that the consumer receives a perfectly smooth cylinder when assembled, without kinds that interfere with sanding.

SUMMARY OF THE INVENTION

In accordance with the present invention, there is provided a new and improved method of and apparatus for linear sanding employing a hand-held, power-driven sander that will supplant the ubiquitous rotary and orbital, hand-held wood sanders. This is achieved by providing a unique, in-line sanding roller having a cylindrical sanding sleeve connected by a one-way clutch to the sanding roller. The sanding roller with the sleeve thereon comprises a roller assembly that provides a soft cushion sanding of the substrate that conforms to and rides on the substrate surface, rather than digging into the substrate surface at high or low spots on the substrate surface. The preferred roller assembly is soft enough that the roller and sanding material deflect into a wider area of contact between the sanding roller and the substrate surface. Harder, stiff resilient rollers of the prior art such as disclosed in U.S. Pat. No. 3,793,782 do not bend or deflect sufficiently, and the sanding roller thereon tends to jump or chatter when encountering high or low spots or too much resistance in the wood substrate surface, and tends to dig into the wood at times. In contrast, the preferred roller assembly is a soft, foam rubber or plastic roller that bends and deflects and rides on the wood without digging into the wood as the soft roller bends, deflects and flows over high or low spots so that there is little bouncing or chatter that causes the sanding roller to dig deeper into the wood as the hard, prior art resilient rollers will do. Because the soft, resilient, foam rubber or plastic roller and sanding sheet roller thereon deflects into a wider contact with the wood, there is provided a flat, wider area of wood sanding contact as contrast to the thinner, straight line of contact of a circular roller that is not substantially deflected. This deflected wider area and softness provides a wider sanding area thank line contact, and it also provides a flowing continuous contact area across higher and lower spots on the wood surface area. The very soft, foam rubber or plastic allows good contact with faces or sides of wood sheets, cabinets or furniture, metal and solid surfaces of Avonite or Corian®.

In order to efficiently mount a tubular sleeve, roll of sandpaper, or the like onto the foam rubber or plastic roller, it is preferred that the roller's outer, cylindrical surface and sandpaper roll's inner, cylindrical surface have a one-way clutch-type of interconnection that allows the roll to be turned as the sandpaper roll is telescoped axially on the roller. As the roll is moved axially along the roller, the roll is turned in a direction reverse to the sanding direction while the foam rubber or plastic is being compressed. That is, the sanding tubular roller is being turned in a reverse direction as it is being slid axially along the roller as the sleeve is compressing the roller. When the tubular sanding roll is on the roller, and the roller is turned by the motor, the one-way clutch surfaces are engaged so that the roll does not slip relative to its driving roller. Preferably, the relaxed, diameter of the uncompressed, foam rubber or plastic layer on the roller is larger than the diameter of the hollow bore of the tubular sanding roll such that the foam rubber or plastic layer is slightly compressed in the radially inward direction by the applied sanding roll; and the compressed plastic foam applies an even, outwardly directed radial force against the inner surface of the sanding roll. This outwardly directed force maintains the sanding roll taut and conforming to the plastic, foam, roller layer as the sanding roller is deflected by forces applied thereto at the wood surface.

In some furniture sanding applications, such as the sanding of the surfaces of wooden doors, the present invention has reduced the time to about one-seventh from that needed to sand the doors with a rotary sanding disk followed by a hand removal of the cross-grain swirls. With the in-line, linear sanding roller method of the present invention, the sanding is done in line with the wood grain, instead of across the grain. Typically, the in-line sanding roller method of the present invention affords a much wider swatch, e.g., 9–20 inches, than a typical 4–6 inch diameter sanding disk. An appreciation of the operating speed and area sanding surface for the present invention can be understood from a comparison of the present invention with an orbital sander, a four-inch disk rotary sander and the illustrated embodiment of the invention using two rollers of nine-inch length and a three-inch circumference. Assume that the orbital sander sands at 10,000 rpms with a 1/32 inch diameter displacement. The sanding speed is about 0.02 miles per minute, which is calculated by the formula:

$$\left(\frac{\text{circumference} \times \text{rpms}}{12} + 5280\right)$$

If the orbital unit has 26 square inches of sanding area and a sanding speed of 0.02 miles per minute, it provides a sanding effectiveness of 0.52 square inch miles per minute. The four-inch rotary disk sander rotating at 10,000 rpms will have a sanding speed of about 2.0 miles per minute, which is 100 times faster than the orbital sander. The area of sanding for the disk sander is typically about 12.57 square inches. But because the disk sander is tilted in use, only about 5.5 square inches are effectively engaging the flat surface of its total area of 12.57 square inches. If the three-inch rollers of the present invention are rotated at 3,500 rpms, the speed is 0.53 miles per minute, which is about 26.5 times faster than the orbital sander. While the disk sander is faster at about 2.0 miles per minute it only has about 5.5 square inches; and this gives a sanding effectiveness of 2×5.5 or 11 square inch miles per minute for the disk sander. The present invention provides 31.50 inches of effective sanding, assuming that a 1.75 inch flat comes in contact with the wood and at a speed of 0.53 miles per minute. This gives an effectiveness of 16.7 square inch miles per minute. Thus, the present invention provides a substantially greater effectiveness than either the orbital disk sanders. It is, of course, relatively easy to increase the roller diameter size in the present invention to increase the width of the wood surface engaged and thereby increase the effectiveness of sanding surface covered. The real effectiveness and time benefits obtained with the present invention are often about 7 times or more faster over a rotary sander because one does not have to hand sand the cross grain scratches out with the invention as one must sand out after using the rotary sander. On the other hand, the sander may have a single roller, e.g., about nine inches in length and three inches in diameter, centered on the motor unit and driven at one end; and for such a one-roller, the effectiveness would be reduced by one-half but still exceeds that of the aforementioned disk sander. The soft cushioned sanding of the present invention rides with wood and does not dig into the wood as do the harder, though resilient, pads or rollers used in prior art sanding equipment.

In accordance with another aspect of the invention, the tubular sanding sleeve for telescoping onto the soft roller may be shipped and stored in a flat sheet state and erected by user into a tubular sleeve for telescoping onto the soft roller. In the preferred embodiment, the opposite longitudinal edges of the flat sanding sheet are formed with interlocking edges. At the time of fabrication of the sleeve, the opposite diagonal ends of the interlocking edges are brought into sliding interlocking engagement; and as the edges are progressively slid along one another, the sheet takes a tubular sleeve shape with the interlocking edges forming a helical seam on the tubular sleeve. The sandpaper covers the interfitting edges which are preferably male and female dovetails that interlock and are covered by a sandpaper flap which may be held down by an adhesive. Because the helical seam is small and only a small portion of the seam engages the substrate at the time of sanding, the seam does not mar the sanded surface.

DETAILED DESCRIPTION OF THE PREFERRED EMBODIMENT

Figure 1:
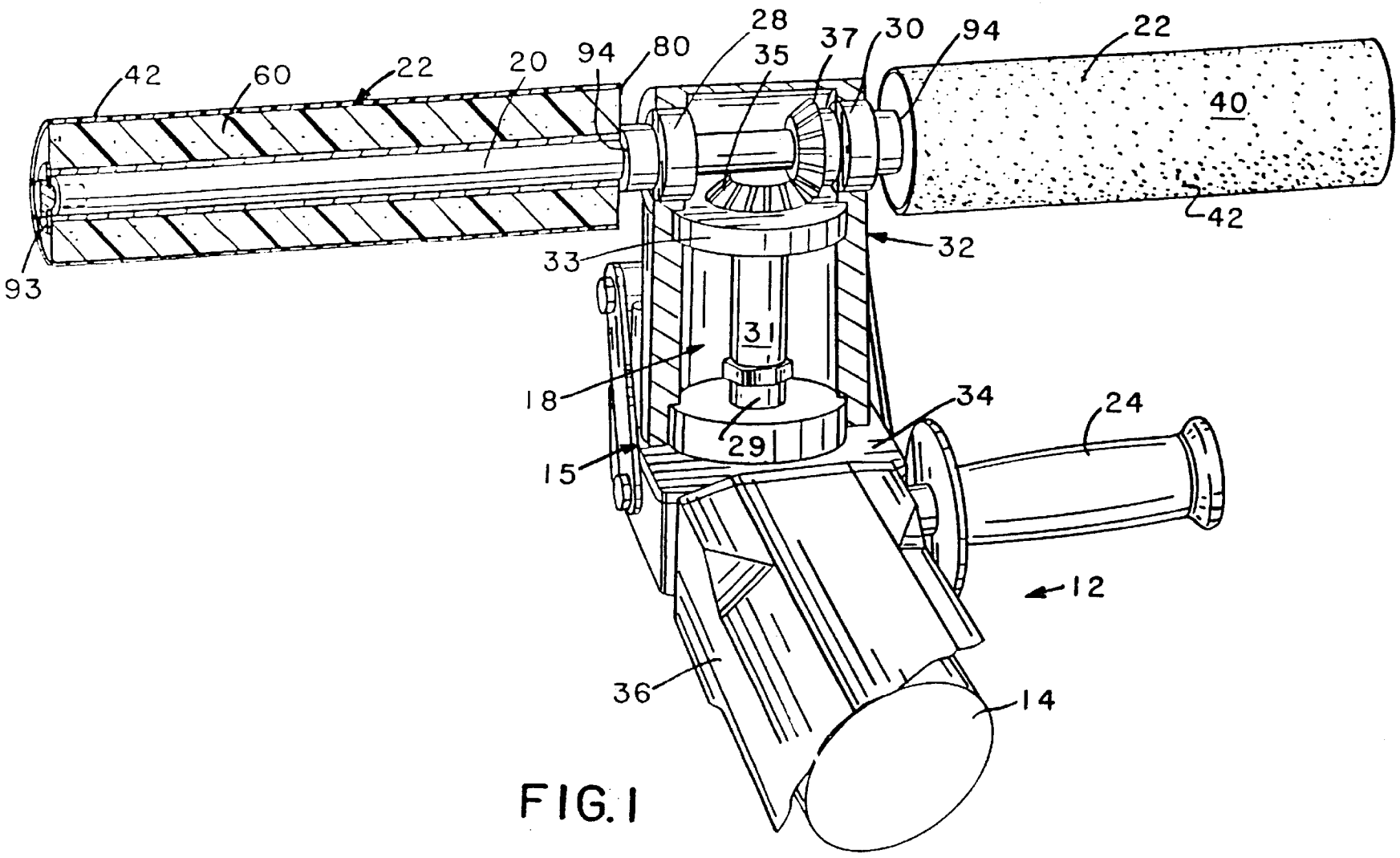
FIG. 1 is a fragmentary perspective view of a roller sanding machine embodying the invention.

As shown in the drawings for purposes of illustration, the invention is embodied in a sanding apparatus 10 that comprises a motor housing 12 within which is a motor 14 which is usually an electric motor, (although it could be a pneumatic motor) driving through its motor shaft 15 (FIG. 2) a transmission or drive 16 range angle power drive 18 to rotate a roller drive shaft 20 on which are mounted a pair of rotatable abrasive rollers 22.

A side handle 24 is also mounted to the drive unit 14 of the apparatus 10. The side handle 24 extends transversely of the motor housing 12 and can be interchangeably mounted on either side of the apparatus.

The side handle is grasped by the user when sanding. The sanding apparatus is an in-line sanding apparatus in that the rollers 22 travel straight forwardly along the surface of the wood or substrate usually in the direction of the grain, as shown by the arrow A in FIG. 5. There may be a single roller driven at one end of the roller with the single roller centered on the motor drive 16, or there may be the pair of rollers 22 with a central drive between the rollers, as illustrated.

Herein, the roller shaft 20 is rotatably mounted in a pair of bearings 28 and 30 mounted in a transmission frame or housing 32, which is secured to a base 34 of a motor housing 12 for the motor 14. The shaft 20 is free to rotate about a horizontal axis through the bearings. For high speed removal of wood from a wood surface, the shaft is rotated at high speed, e.g., 2,000 to 3,000 rpm or higher. Because the preferred rollers have abrasive sheets 40 thereon with a diameter, e.g. of 3 inches, the peripheral velocity of the sheet against the wooden surface is quite high.

In this illustrated embodiment of the invention, the right angle drive 18 comprises a shaft coupling 29 (FIG. 1) connecting the motor output shaft 15 (FIG. 2) and a drive shaft 31 that is journaled for rotation in a bearing plate 33 of the frame 32 and carries a beveled gear 35 at one end. The beveled gear 35 is meshed to a beveled gear 37 which is fixed to the roller shaft. Thus, rotation of the motor shaft 15 turns the transmission shaft 31 to rotate the beveled gears 35 and 37 to rotate the roller shaft 20 and the rollers 22 thereon.

Figure 2:
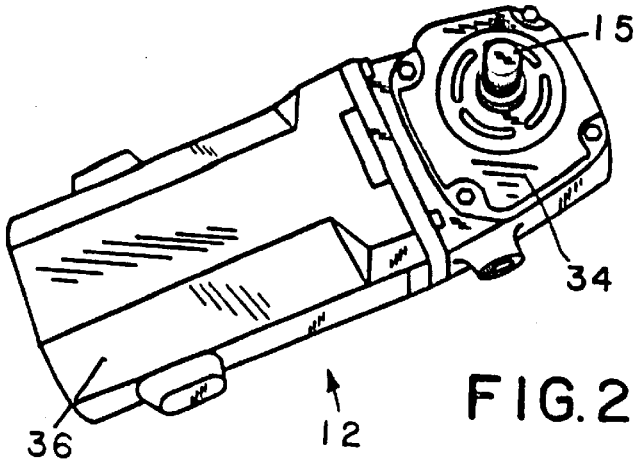
FIG. 2 is a bottom perspective view of the motor housing and motor-driven shaft.

In this illustrated embodiment of the invention, the right angle drive and its frame or housing may be separated from the motor housing 12 to leave the motor housing and the motor detached, as shown in FIG. 2. An anti-rotation bracket 37 is connected between the motor housing 12 and the transmission housing 32 to prevent rotation of the transmission housing when the power shaft 15 is driving the transmission shaft 31 and the beveled gears 35 and 37. The anti-rotation bracket comprises a link 38 connected at one end to the handle 24, and connected at its other end to a pin portion 39 of the bracket fixedly secured to the transmission housing 32. It may be desirable to make the apparatus as one unit without a detachable transmission and roller shaft unit, in which case the same housing will be used for both the motor and the right angle transmission drive.

Figure 6:
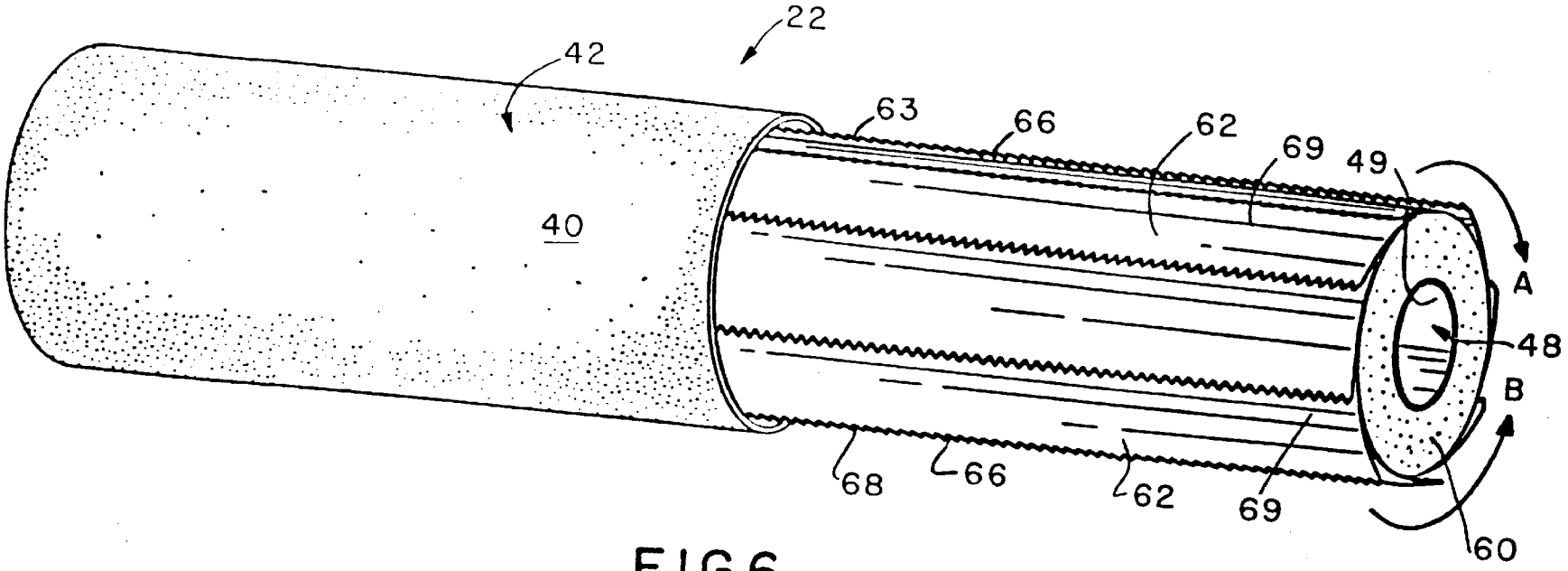
FIG. 6 is a perspective view of a sanding sleeve being telescoped onto a driving roller therefor.
Figure 9:
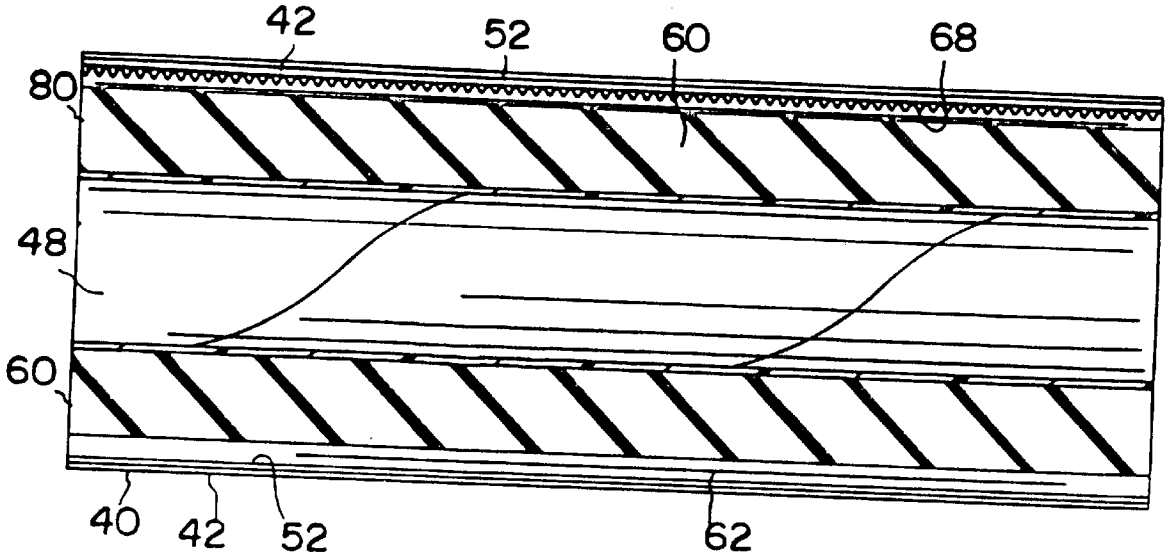
FIG. 9 is a longitudinal, cross-sectional view of the sanding roller.
Figure 10:
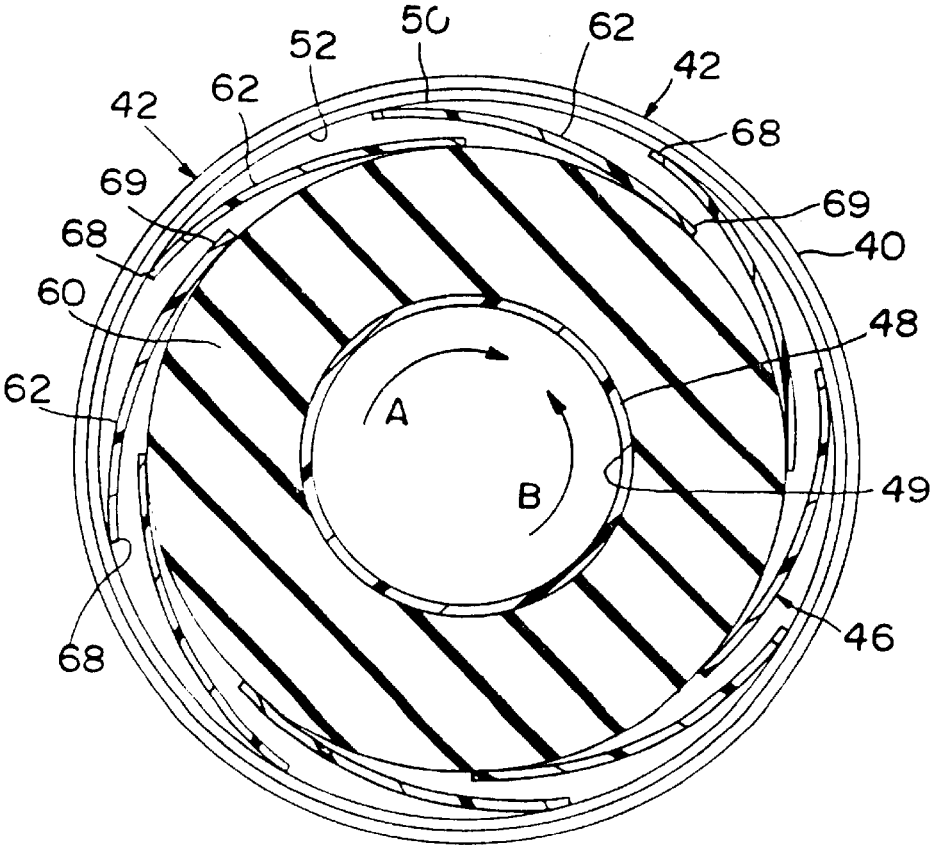
FIG. 10 is a cross-sectional view of the sanding roller.

Referring now to FIG. 6, there is shown therein a partially assembled roller assembly which comprises an outer tubular sleeve 42 having the abrasive layer 40 on its outer surface and a cylindrical drive roller 46. The cylindrical drive roller 46 can be inserted within the tubular sleeves 42 and, as shown in FIGS. 6, 9 and 10, the drive roller can be fully inserted within the sleeve 42.

Figure 3:
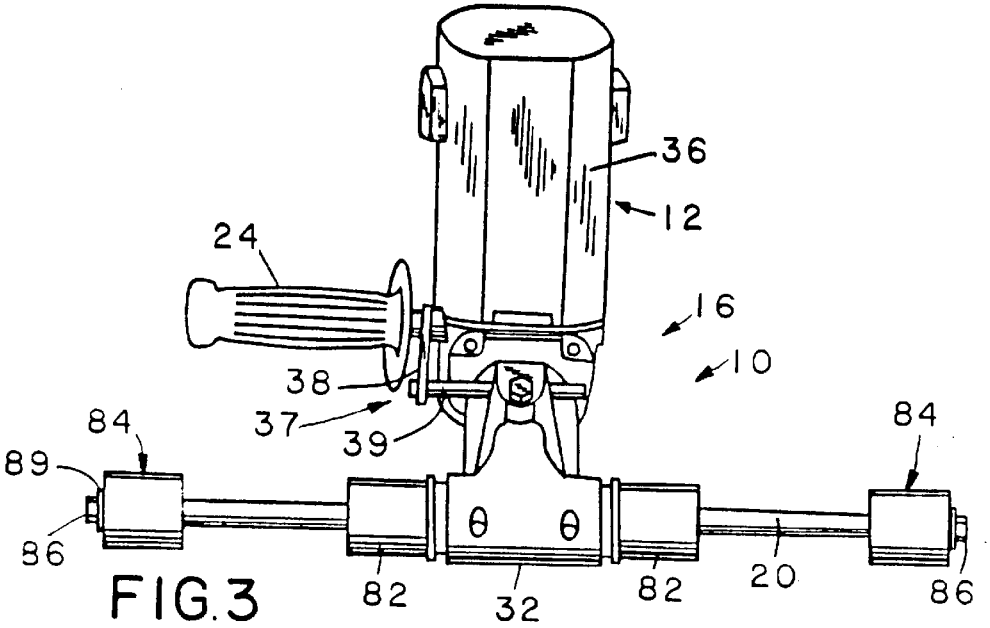
FIG. 3 is front elevational view of the roller sanding machine of FIG. 1.
Figure 4:
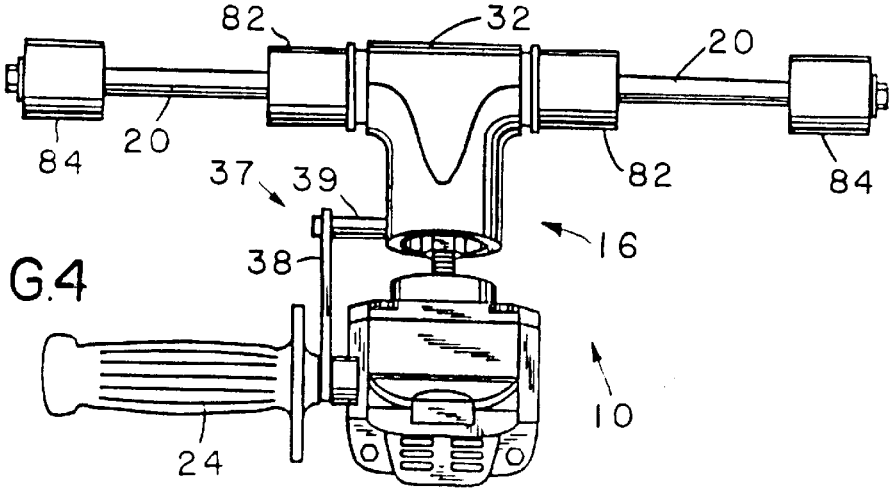
FIG. 4 is a rear elevational view of the sanding machine of FIG. 1.

The cylindrical drive roller 46 includes an inner cylindrical tube 48, having a smooth inner surface 49. The inner surface 49 of the roller allows the roller to be slid longitudinally and mounted on the rotating drive shaft 20 of the roller sanding machine 10 (FIG. 3), as will be described in connection with FIG. 11.

Figure 7:
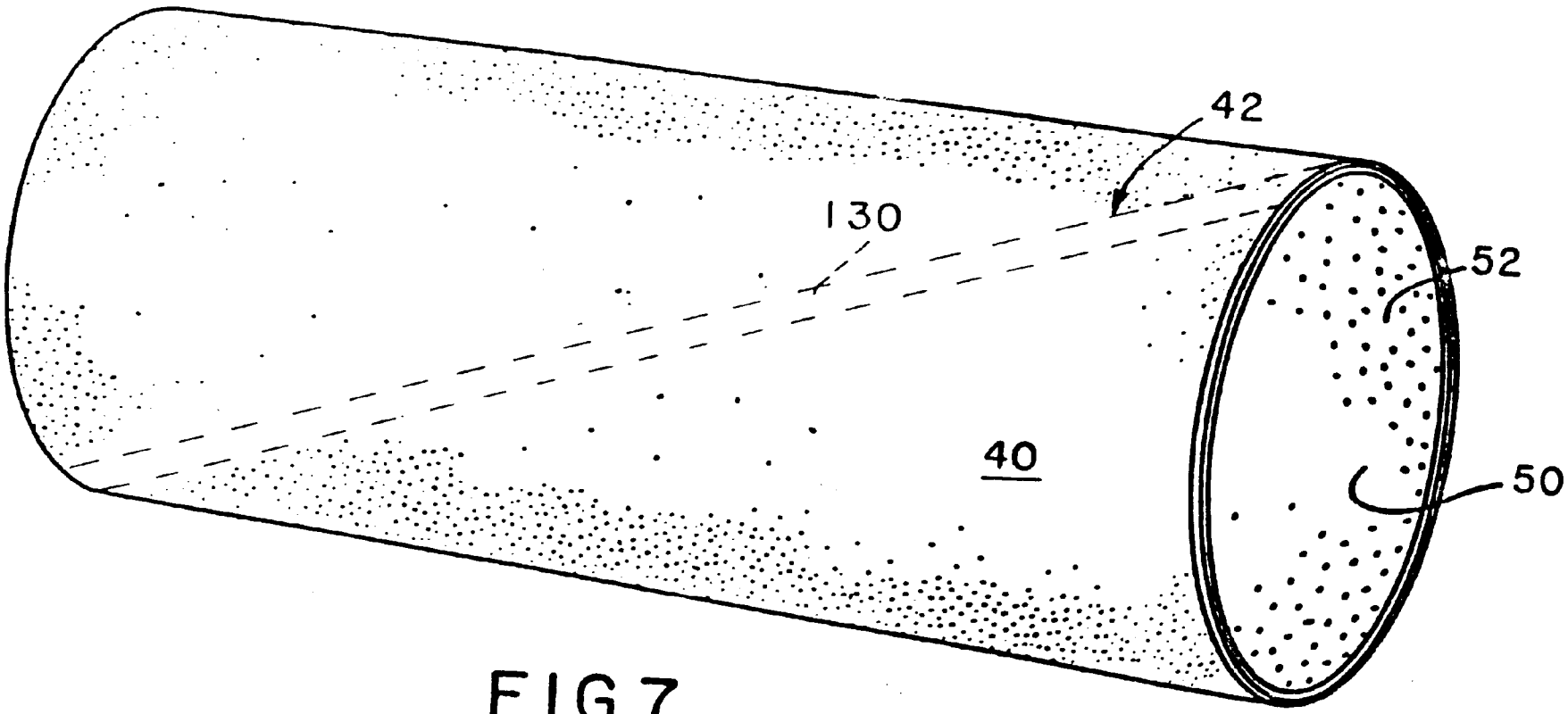
FIG. 7 is a perspective view of the sleeve.

Referring now to FIG. 7, the sleeve 42 has an outer, abrasive layer or surface 40 and an inner surface 50. The abrasive layer 40 will typically be a sheet of sandpaper which can have any suitable abrasive or sanding material thereon, e.g., a non-woven abrasive material such as one sold under the trademark SCOTCH-BRITE™ manufactured by 3M of Minneapolis, Minn., or BEAR TEX™ manufactured by Norton Abrasives of New York, N.Y., United States of America, steel wool, or sand material, which is used for finishing wood or any other sandable surface.

For the purpose of providing a rotatable and axially slidable engagement with the drive roller 46, the inner surface of the sleeve is provided with an interconnecting or clutch material. Herein, the inner surface 50 of the sleeve 42 has a coarse, looped material 52 thereon for catching engagement when turned in one direction relative to toothed clutch elements on the drive roller 46. The coarse, looped material 52 has a plurality of filament loops which can be a polyester material, such as sewing fleece or the looped material 52 may be the loop type fastener assembly used with hooks and is part of hook and loop assemblies sold under the trademark VELCRO™. Also, any ordinary scrim fabric therein holes therein to accept the teeth 68 of the plastic strips may be used.

Figure 8:
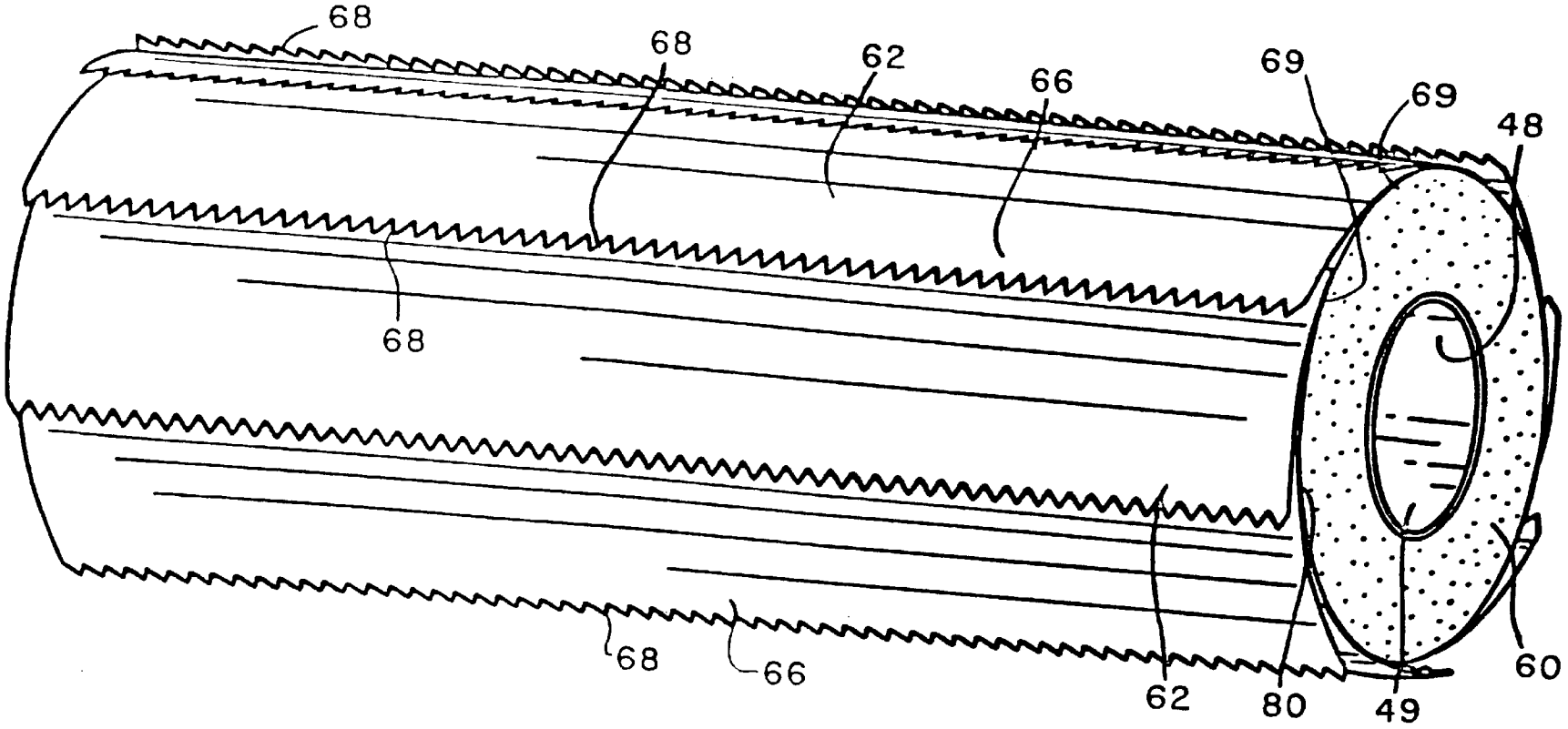
FIG. 8 is a perspective view of a clutch means on the driving roller.

The inner cylindrical tube 48, shown in FIG. 8, within the drive roller 46 is made of a rigid material, such as metal, plastic or cardboard so that the cylindrical tube 48 can be mounted to the rotating roller shaft of a roller sanding machine (shown in FIG. 1), a spindle sander (not shown) or a hand-held drill (not shown).

Encircling the rigid tube 48 of the cylindrical roller 46 is a cylindrical layer of a compressible, soft, resilient material 60. The compressible, resilient material 60 preferably is a plastic, polyurethane, foam material of various densities 60 and is attached to the outer surface of the cylindrical tube 48 by an adhesive. The foam material 60 may also be extruded integrally with the tube. The foam material 60 provides the softness to the sanding sleeve to have the sanding sleeve flatten and conform to the surface of the substrate being abraded.

The one-way clutch interconnection between the sleeve 42 and the drive roller 46 preferably comprises a series of elongated, serrated plastic strips 62 wrapped circumferentially about the foam material 60. The serrated edges of the plastic clutch strips 62 engage and hook into the loops of the looped material when the drive roller is rotated in the driving direction shown by directional arrow B in FIG. 6. The engagement strips 62 have a front end or edge 66 and a back end or edge 69. The back end 69 of each engagement strip 62 is attached to the foam material 60 by an adhesive, such as glue or tape.

The front end 66 of each engagement strip 62 is free, i.e., not attached to the foam material 60. Additionally, the front end 66 of each engagement strip is serrated to form teeth 68 which are cut into a front end edge of the strip 62.

As best shown in FIG. 6, the engagement strips 62 are flexible so that the strips 62 can be resiliently bent to conform to a circumference of the foam material 60 and the tube 48. The attached strips are preferably positioned on the foam material so that when the strips are bent to conform to the shape of the foam material and tube, the loose front edge of each engagement strip overlaps the attached back end of the engagement strip just in front of it. Also, a sufficient number of engagement strips are used so that when the foam material is compressed, the engagement strips completely cover the foam material in the described overlapping manner.

The diameter of the uncompressed roller 46, including the diameter of the tube 48, the thickness of the uncompressed foam material 60 on the tube 48 and the thickness of the overlapped plastic strips 62 attached to the foam material on the tube, is slightly larger than an inner diameter of the sleeve 42.

Therefore, in order to insert the roller 46 into the sleeve 42, the foam material 60 of the roller 46 must be compressed; and the roller 46 must be simultaneously pushed into the sleeve and rotated in a first direction, with respect to the sleeve, as shown by an arrow A in FIG. 6, such that the teeth 68 of the plastic strips 62 will not engage the looped material 52 on the inner surface 50 of the sleeve 42. When the roller 46 is rotated in direction A, the plastic strips 62 of the roller easily slide along the looped material and the roller is easily inserted into the sleeve. The direction of rotation of the roller in the first direction A, as shown in FIG. 6, is clockwise with respect to the sleeve.

Referring now to FIGS. 9 and 10, once the drive roller 46 is inserted into the sleeve 42, the foam material 60 and strips 62 are allowed to expand within the sleeve. Although the foam material expands to fit tightly within the sleeve, the foam material and plastic strips are constrained by the sleeve and cannot expand completely to their original shapes. Because the foam material 60 is still constrained by the encircling sleeve 42, the foam material applies an even, outwardly-directed, radial force against the inner surface 50 of the sleeve.

As best illustrated in FIG. 10, when the roller 46 is inserted into the sleeve 42, the teeth 68 of the bent plastic strips 62 all point in the same direction along the circumference of the roller such that the teeth will engage the looped material 52 if the roller is rotated in a second direction, B, as shown by an arrow in FIGS. 6 and 10. Note that the second direction, B, is opposite the first direction, A, and, as shown in FIG. 6, is in the counter-clockwise direction with respect to the sleeve.

When the roller 46 is completely inserted within the sleeve 42, the roller and sleeve form an assembled roller and belt assembly and, as previously described above, the assembled roller and belt assembly can be attached to the rotating shaft of a roller sanding machine (FIG. 1), a spindle sander or a hand-held drill.

As best seen in FIG. 10, the plastic clutch strips 62 have a spring bias to extend their serrated edges 68 radially outwardly to hook into the looped material 52. When the drive roller is driven counterclockwise in the sanding direction in FIG. 10, the serrated edges dig into the looped filaments to prevent slippage between the sleeve and drive roller. The plastic clutch strips are thin and flexible so that the roller may be pushed to provide a flat and then spring back and return to the positions shown in FIG. 10 when the adjacent flattened screen portion rotates from contact with the wood substrate 108. It is possible to push with such extremely hard forces that the flat 109 becomes very large and the serrated teeth become substantially disengaged from the looped material 52; but such forces are too large for sanding. A more dense material may be added to the core of the foam to prevent the foam from compressing beyond a preferred compression. Other one-way clutch means may be used other than that illustrated and fall within the purview of this invention.

When the roller and belt assembly is used to sand an object, the assembled roller and belt assembly must be attached to the rotating shaft so that the roller 46 will be driven or rotated in the second direction, B, to ensure that the teeth 68 will engage the looped material 52 and thereby rotate the sleeve without causing the sleeve to slip or creep off of the roller.

After substantial use, a worn sleeve 42 can be removed from the roller 46 easily and replaced by a new sleeve. The worn sleeve is removed from the roller by simultaneously rotating the roller in the first direction, A, so that the teeth 68 do not engage the looped material 52 and pushing the roller out of the sleeve. Then, a new sleeve can be placed on the roller in the same manner described above.

The preferred manner of attaching a sanding roller 46 with an abrasive sleeve 42 thereon to the rotatable roller shaft 20 is by providing a pair of spaced bushings 82 and 84 (FIG. 11) mounted on and secured to the roller shaft 20 at axially spaced locations. The first bushing 82 is mounted inwardly adjacent the housing 32 and has a flange 79 on one end against which abuts the inner end wall 80 of the sanding roller 22 to limit the extent of roller insertion on the shaft. The bushing has an outer diameter surface 82*a* sized to the internal bore diameter of the roller tube 48 (FIG. 6).

At the outer ends of the shaft 20 (FIG. 11) are the second expandable bushings 84 (FIG. 11) which are cylinders made with an expandable body 88 of elastomeric material with a good coefficient of friction. After sliding the roller 46 on the first and second bushings 82 and 84, an outer nut 86 is turned on a threaded end portion 91 of the shaft 20 toward a pair of metal disks 89 and 90. The disk 90 is fixed to the roller shaft 20 and the disk 89 slides on the shaft. The nut 86 is turned on the threaded end 91 of the shaft 20 to abut the adjacent metal disk 89 and forces it to the right, so that the bushing body 84 is compressed between the disks 89 and 90. The compressed bushing body 84 expands in diameter to come into intimate tight engagement with the bore defining wall of the roller tube 48. This provides a releasable, non-slip drive between outer bushing 84 and a roller 46 thereon. When it is desired to remove a sanding roller, the nut 86 is turned to travel outwardly in the direction of the free end of the roller shaft 20, thereby removing the compressing force on the elastomeric body 84 allowing it to contract and to decrease its diameter. This allows the roller to be slid from the bushings 82 and 84 for removal.

Figure 11:
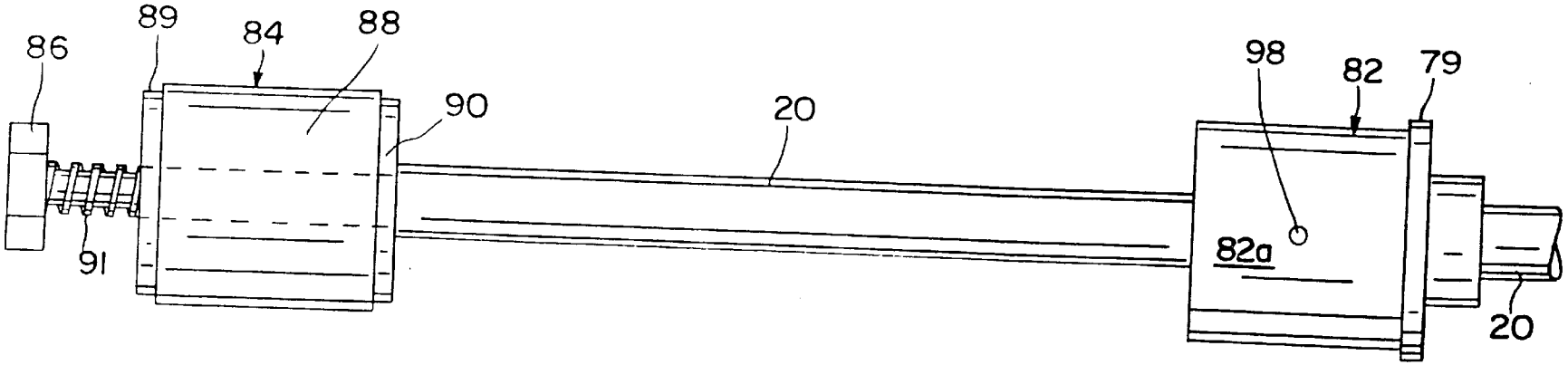
FIG. 11 is a fragmentary, elevational view of the drive shaft and bushings for the sanding roller.

The inner bushings 82 each have a radially-directed set screw 98 (FIG. 11) projecting through the body 82*a* of the bushing 82 with the inner end of the set screw engageable with the roller shaft 20. The set screw may be loosened to allow the bushings 82 to be slid longitudinally along the roller shaft. After being positioned on the roller shaft at the desired location, the outer ends of the set screws are engaged with a tool and turned in threads in the bushings 82 to drive the inner ends of the set screws tightly against the roller shaft. In this manner, the inner bushings 82 are secured to the shaft at positions for length of sanding roller being slid upon the bushings 82 and 84 (FIG. 11).

On the other hand, if the rollers 22 are to be fixed to the roller shaft and are not readily removable, the expandable bushings 84 described above are not needed. In FIG. 1, the roller 22 is shown as having a tight, force fit engagement between the roller tube 48 and the shaft 20. The inner end 80 of each roller abuts a shoulder wall 94 with a retaining lock ring 93 fixed on the outer ends of the shaft to abut the outer ends 80 of the roller.

The preferred, soft layer backing 60 for the sanding layer or sheet 42 is a soft material, such as a sponge or foam rubber or plastic, that has pores. The illustrated soft foam rubber or plastic layer is the type of foam that is used for painting with a roller. That is, a foam paint roller is mounted on the bushings 82 and 84; and the outer surface of the paint roller is compressed radially inwardly by the sanding sleeve 42 when it is telescoped over the foam layer 60. The compressed foam layer applies radially outwardly-directed forces to the sanding sleeve. It will be recognized that the sanding layer or sleeve could be permanently attached or bonded to the outer face of a foam layer; and that this composite of foam and sanding sleeve could be attached to the driving axle 20 to provide the rotatable sanding roller.

Figure 5:
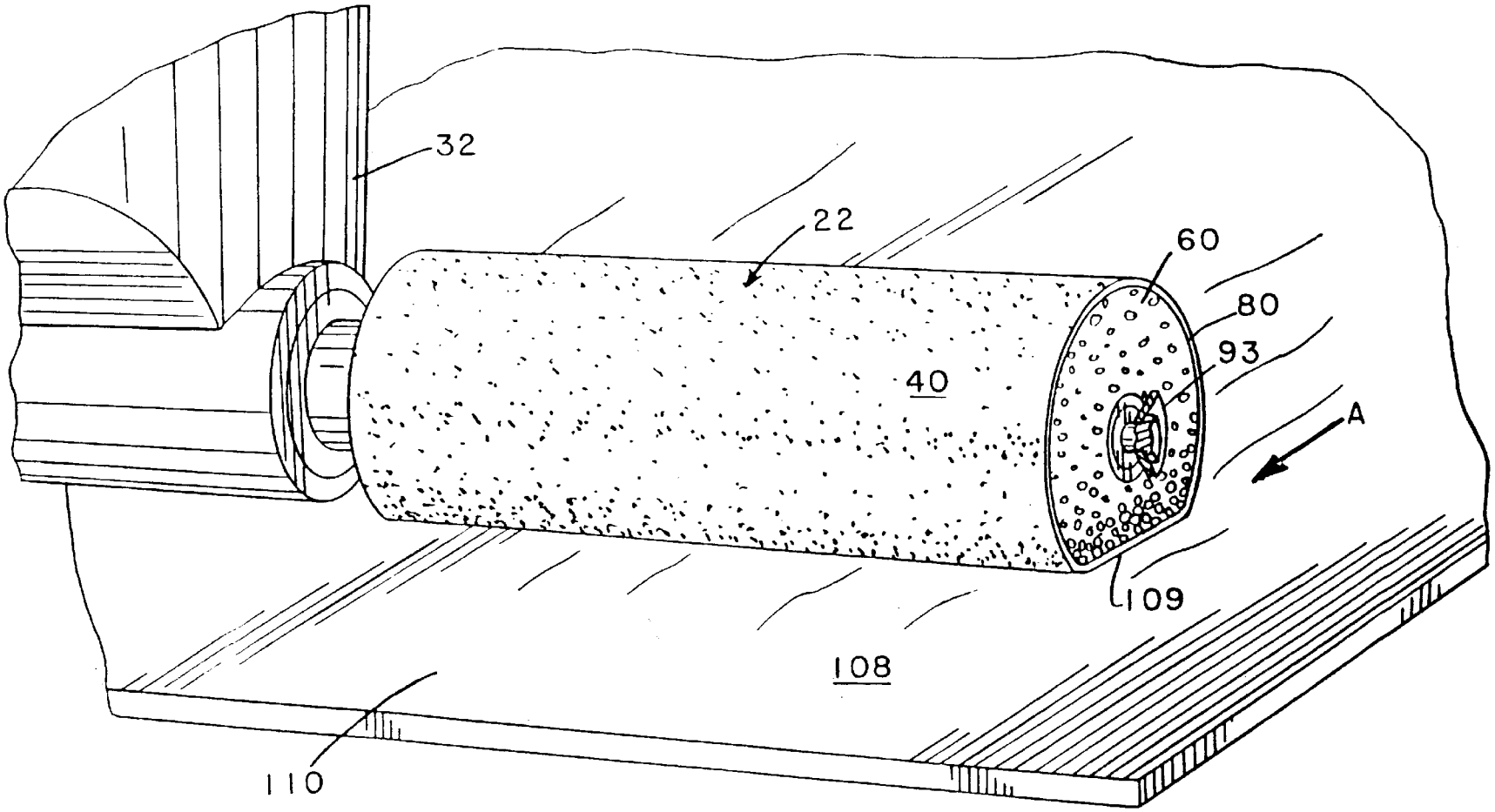
FIG. 5 is a perspective view of one of the rollers sanding a substrate.

In use, the operator pushes the sanding roller 22 against the flat wood surface 108 (FIG. 5); and the sanding roller has a wide flat area 109 formed on the bottom thereof, as shown in FIG. 5, where the sanding roller engages the wood surface 108 on a wood sheet 110. For the three-inch diameter sanding sleeve described herein, the flattened area 109 is about 1.75 inches in width and extends the full nine inches along the length of the roller. The width of the flat area 109 may vary considerably from the 1.75 inch width that was measured in the illustrated embodiment of the invention and described herein when a typical force was applied while sanding. If the user pushes with less force, the flat area 109 may be smaller than 1.75 inch for the same roller. Manifestly, by changing the softness of the foam rubber or other materials, the width of the flat area 109 can be varied substantially from 1.75 inches and still fall within the purview of the invention. For example, the flat area may range from about ¼ inch in width to greater than 1.75 inch in width. Hard rubber or elastomeric materials will not provide the substantial flat area and will not conform to the surface of the wood, as does the soft compressible sanding roller of this invention. Hard elastomeric or rubber sanding rollers also will chatter when moved along the surface during sanding. This wide flat area 109 provides a large sanding area that a mere line contact with the wood as when there is not a soft compliant layer under the sanding sheet. The soft compliant layer quickly expands the sanding layer outwardly into the cylindrical surface as the previously flattened surfaces travel upwardly in a clockwise direction from the wood surface. Of course, the downwardly moving curved area on the roller adjacent the wood flattens as it engages the wood. Because of the soft, compliant, backing layer, the sanding layer rides softly on the top of the wood and conforms thereto and it travels over low or high spots without digging in or chattering, as will prior art sanding rollers.

Figure 13:
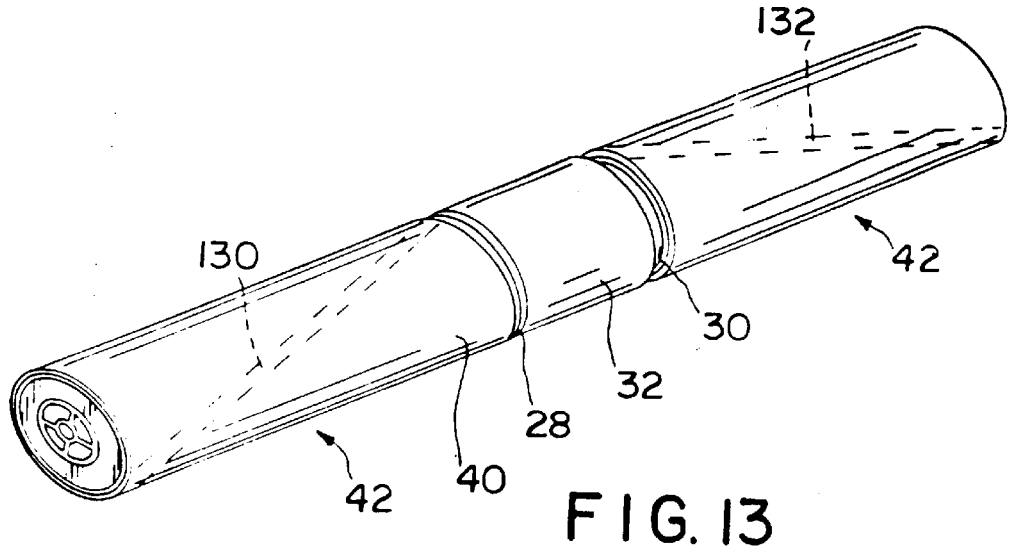
FIG. 13 is a perspective view of a pair of sanding rollers.
Figure 15:
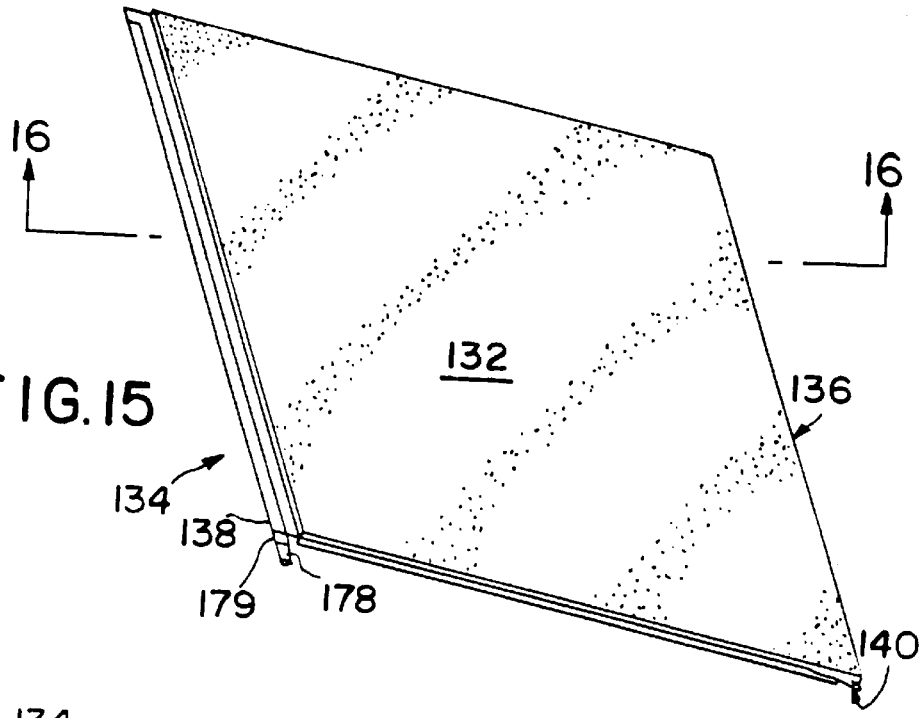
FIG. 15 is a perspective view of a flat sanding sheet.

The sanding sleeve 42 (FIG. 7) may be made either cylindrical and seamless or it may be rolled from a flat sheet 132 (FIG. 15) into a cylindrical shape with a helical or diagonal seam 130 (FIG. 13). The erected cylindrical shape has a large volume or bulk and hence takes considerable shelf space in a store or when being inventoried. On the other hand, the flat sheet 132 has a very small bulk and stacks of sheets 132 may be easily stored in the manner of common sandpaper.

Figure 16:
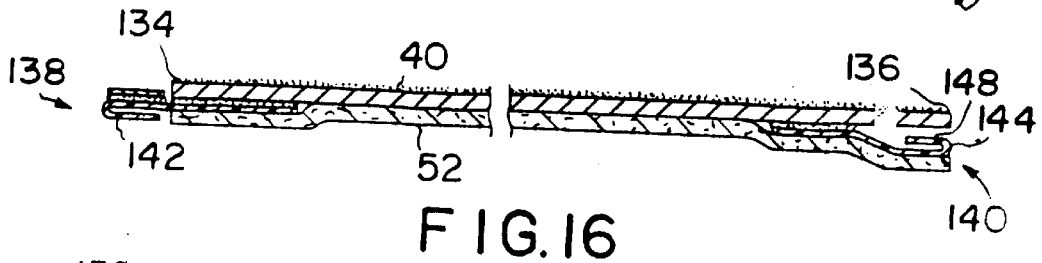
FIG. 16 is a cross-sectional view taken along the line 16—16 of FIG. 15.
Figure 17:
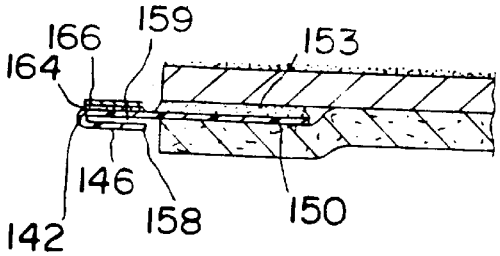
FIG. 17 is an enlarged, fragmentary sectional view of one edge of the flat sheet of FIG. 15.
Figure 18:
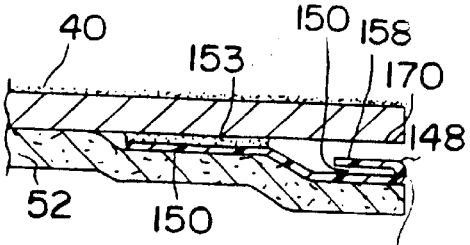
FIG. 18 is an enlarged, fragmentary, cross-sectional view of the opposite edge of the flat sanding sheet.

For the purpose of forming the helical seam 130, opposite longitudinal edges 134 and 136 of the sheet 132 have interfitting and interlocking connections 138 and 140. The preferred interlocking connections are in the form of sliding dovetails formed of thin plastic strips 142 and 144 (FIGS. 16–18) having interfitting hooked ends 146 and 148, respectively. As best seen in FIGS. 17 and 18, each of the strips 142 and 144 may be substantially identical and have a flat large adhering section 150 that is secured or adhered by an adhesive 153 to a respective edge 134 and 136 of the sheet 132 between the outer sanding layer 40 and the inner non-woven, one-way clutch layer 52 that comprise the sheet 132.

Figure 14:
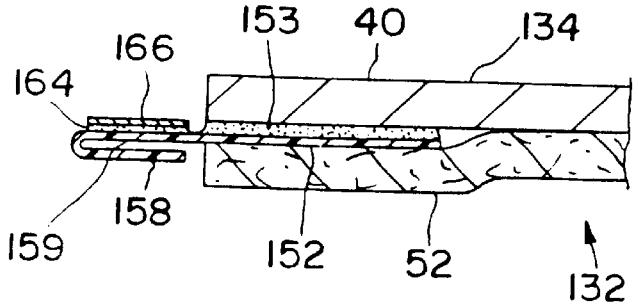
FIG. 14 is an enlarged, fragmentary, cross-sectional view of an edge of the flat sanding sheet in FIG. 15.

The left and right hooked ends 146 and 148 of the respective left and right plastic strips 142 and 144 are formed with a longitudinally-extending free edge or end 158, as best seen in FIG. 14, with a space 159 being located between free ends 158 and the section 152 adhered by the adhesive 153 to and between the layers 40 and 52 that comprise the sheet 132. As seen in FIGS. 14, 16 and 17, the left hooked end 146 of the strip 134 projects outwardly beyond the left edge 134 of the sheet, (FIGS. 14 and 16) whereas the right hooked end 148 on the right edge of the sheet does not extend outwardly of its associated sheet edge 136. The hooked end 148 is disposed beneath the outer abrasive layer 40, as shown in FIG. 16.

When the seam 130 is being formed, the longitudinal free end 158 of the left strip 142 is slid into the space 156 (FIG. 18) of the right strip 144 and similarly the longitudinal free end 158 of the right strip 136 is being slid in the space 159 (FIG. 16) of the left strip 142. When assembled, the hooked edges 134 and 136 are being pulled in opposite directions by the tubularly formed sheet 132 that wants to return to its flat state.

Figure 19:
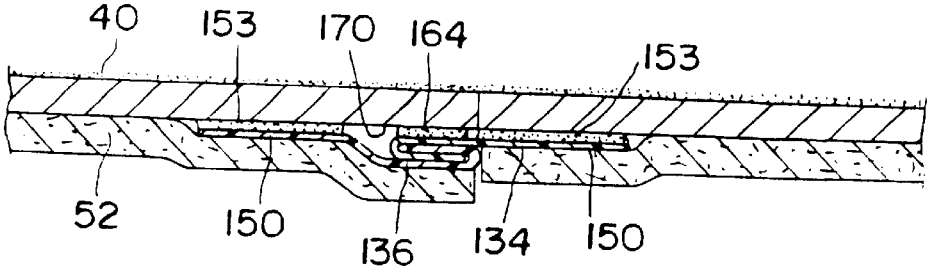
FIG. 19 is an enlarged, fragmentary cross-sectional view of the helical seam of a sanding sleeve.

In order to hold the right end 156 of the abrasive outer layer 40 down tight at the helical seam 130, the left strip 142 (FIGS. 14 and 16) may be provided with a tacky, pressure sensitive adhesive layer 164 (FIG. 14) that is covered by a peelable paper layer 166. When inter-locking the strip edges 134 and 136 are forming the seam 130, the paper layer 166 is stripped from the adhesive layer 164 and the abrasive layer's surface 170 (FIG. 19) is pressed against the tacky layer 164 to adhere the abrasive layer 170 edge to the interlocking strip 136.

Figure 12:
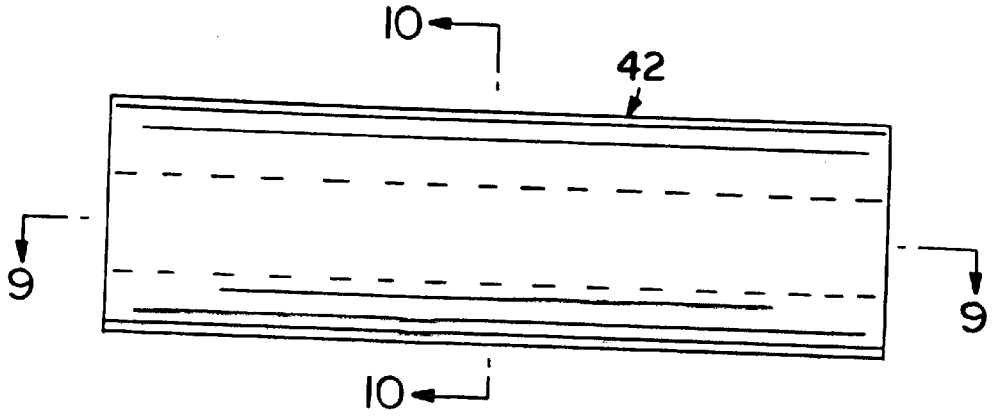
FIG. 12 is a front elevational view of the sanding roller.
Figure 21:
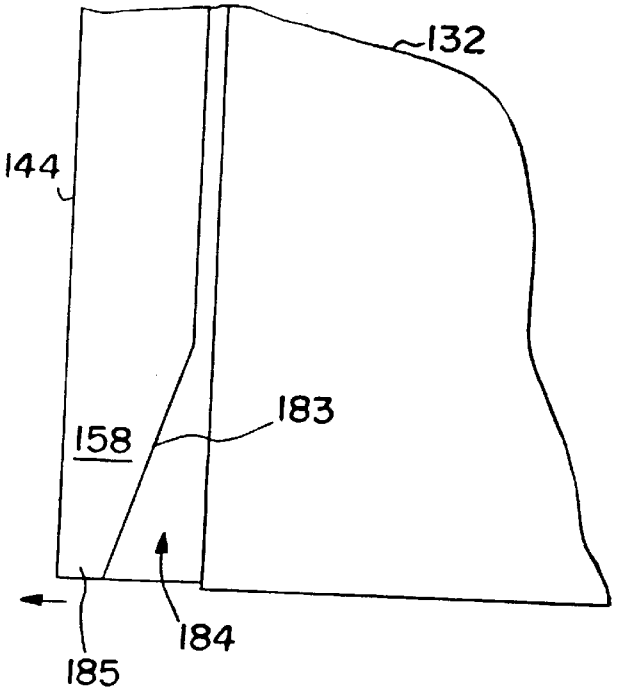
FIG. 21 is a fragmentary, end view of another inclined end on a connecting strip for connection with the inclined end of FIG. 20.
Figure 20:
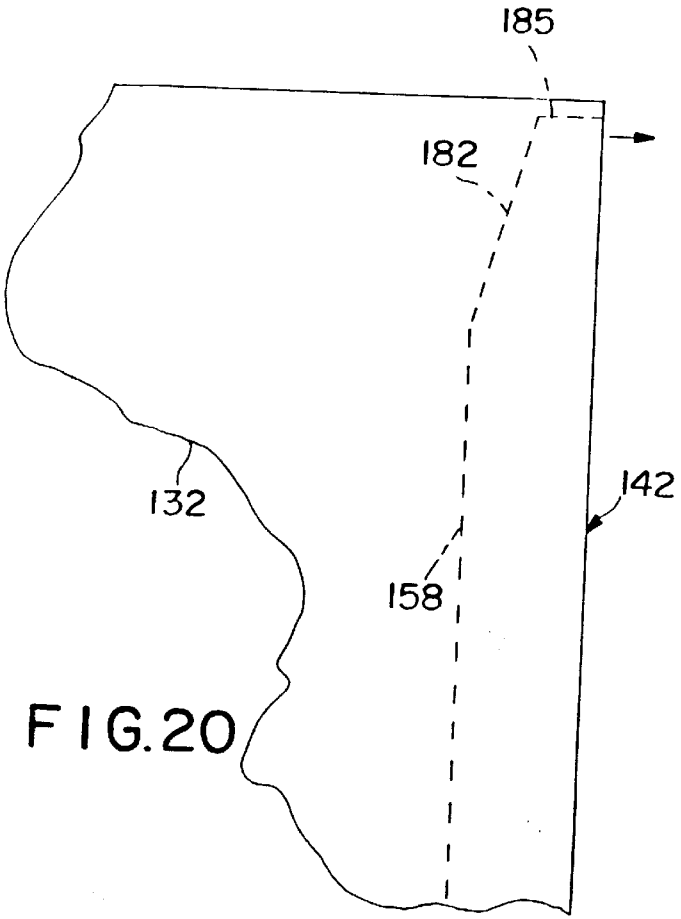
FIG. 20 is a fragmentary, end view of an inclined end on a connecting strip at one side of a sandpaper sheet.

In order to assist the initial sliding insertion of the projecting free ends 158 into the spaces 159, the strip 142 may have a detachable leader portion 178 (FIG. 15) projection beyond the lateral edges 180 and 182 of the sheet. After the seam 130 is complete, the detachable leader portion is broken off at the weakened area 179 in the strip 142 so nothing projects outward from the ends of cylindrical sleeve, as shown in FIGS. 12 and 13. Another way to do this is by tapering the strips 142 and 144 slightly on the starting ends; so when you begin assembly and push them into each other, they snap into place. The left strip 142 and the right strip 144 have opposite ends with a tapered cut-away portion along lines 182 and 183 (FIGS. 20 and 21) in their respective free ends 158 on these strips. This cut-away portion leaves a tapered lead-in gap 184 (FIG. 21) on each strip so that the respective tapered ends 185 on the strips may be more easily threaded. The tapered ends eliminate the need for the projecting leaders 178 (FIG. 15) described above. This eliminates the need for the leader portions 188. When the constructed sanding sleeve with the helical seam 130 is put onto the driving roller 46, the compressed foam material 60 expands and exerts forces, which are directed radially outwardly, to expand the diameter of the sanding sleeve. This results in oppositely directed circumferential forces in the sleeve being applied to the strips 142 and 144 which also tend to flatten the height of the strips. Thus, the seam 130 is flat and tight when it is on the driving roller. Also, because the seam 130 is helical, only a portion thereof will be located at the sleeve flat 109 which is in engagement with the substrate surface 108 (FIG. 5) at the time of sanding rather than an entire straight seam line engaging the substrate surface if the seam were a straight line parallel to the sleeve's longitudinal axis. This helical small engagement of a portion of the seam results in less likelihood of a scratching or marring of the substrate because of the mall engagement with a seam at any portion of the revolution of the sanding sleeve.

What is claimed is:

1. A roller and sleeve assembly for mounting on a spindle or drive shaft and for abrading a workpiece comprising:

a rotating drive roller having a substantially cylindrical shape;

an abrading sleeve mounted on the roller for rotation with the drive roller and having an outer abrading surface thereon for abrading the workpiece; and a one-way clutch between the driving roller and the sleeve allowing axial and rotational movement in a first direction between the sleeve and the drive roller to facilitate mounting of the sleeve on the drive roller and preventing relative, rotational movement between the sleeve and the roller in abrading direction of rotation which is opposite the first direction of rotation;

the cylindrical sleeve has an inner surface defining a first diameter and an outer surface with the sleeve having sandpaper or other abrasive material thereon;

a mounting means at a central rotational axis of the roller for mounting the roller on the spindle or drive shaft;

a resilient, compressible means being mounted on the roller assembly and having a second diameter, when in an uncompressed state, which is at least as great as said first diameter of the sleeve; and the resilient compressible means being compressed to a smaller dimension than the second diameter when the compressible means is compressed during the abrading of the workpiece.

2. The roller and sleeve assembly according to claim 1 wherein said second diameter of the cylindrical, resilient, compressible means is greater than said first diameter and wherein said cylindrical, resilient, compressible means is received within said sleeve in a compressed state.

3. The roller and sleeve assembly according to claim 1, wherein said one-way clutch is defined by sliding means disposed between the cylindrical, resilient, compressible means and the sleeve.

4. The roller and belt assembly of claim 1 wherein said resilient, compressible means includes a foam material.

5. The roller and belt assembly of claim 1 wherein said resilient, compressible means comprises an annular band of foam material wrapped about a central hard core.

6. The roller and belt assembly of claim 3 wherein the resilient, compressible means and the sliding means define said second diameter which is slightly larger than said first diameter.

7. A roller and belt assembly according to claim 6 wherein said sliding means comprise plastic strips attached to the resilient, compressible means, said strips having teeth engaged with the engageable means on the inner surface of said sleeve.

8. The roller and belt assembly according to claim 1 wherein the cylindrical sleeve is deflectable to provide a flat on a side engaging and sanding a substrate underlying surface and for traveling linearly along the substrate surface, and wherein said roller assembly has a first cylindrical shape to hold the cylindrical sleeve in a cylindrical shape prior to sanding and is deformable into a second shape with a substantial flat to support the flat on the cylindrical sleeve as the assembly is pushed linearly along the substrate surface.

9. The roller and belt assembly according to claim 1 wherein the resilient, compressible means includes a material having pores.

10. The roller and belt assembly in accordance with claim 1 wherein the resilient, compressible means includes material of foam rubber or plastic and has a radial thickness several times the radial thickness of the cylindrical sleeve.

11. The roller and belt assembly in accordance with claim 1 wherein said one-way clutch is between the resilient, compressible means and the cylindrical sleeve.

12. The roller and belt assembly according to claim 3 wherein said one-way clutch includes at least two plastic strips each having a front end and a back end, said front ends having teeth and said back ends being attached to said resilient, compressible material.

13. A roller and sleeve assembly for mounting on a spindle or drive shaft and for abrading a workpiece comprising:

a rotating drive roller having a substantially cylindrical shape;

an abrading sleeve mounted on the roller for rotation with the drive roller and having an outer abrading surface thereon for abrading the workpiece; and a one-way clutch between the driving roller and the sleeve allowing axial and rotational movement in a first direction between the sleeve and the drive roller to facilitate mounting of the sleeve on the drive roller and preventing relative, rotational movement between the sleeve and the roller in abrading direction of rotation which is opposite the first direction of rotation; , wherein said one-way clutch includes a sewing fleece.

14. A roller and sleeve assembly for mounting on a spindle or drive shaft and for abrading a workpiece comprising:

a rotating drive roller having a substantially cylindrical shape;

an abrading sleeve mounted on the roller for rotation with the drive roller and having an outer abrading surface thereon for abrading the workpiece; and a one-way clutch between the driving roller and the sleeve allowing axial and rotational movement in a first direction between the sleeve and the drive roller to facilitate mounting of the sleeve on the drive roller and preventing relative, rotational movement between the sleeve and the roller in abrading direction of rotation which is opposite the first direction of rotation; , wherein said one-way clutch includes a looped material such as the looped material used in a hook and loop fastener assembly sold under the trademark VELCRO™.

15. An abrading sleeve for detachably mounting on a rotatable roller, said abrading sleeve comprising:

a closed loop sleeve having a hollow interior bore;

an outer surface on the cylindrically-shaped sleeve having an abrasive material thereon;

an inner surface on the sleeve bore; and a portion of a one-way clutch located at the inner surface of the sleeve for driving connection with a clutch portion on the roller when the roller is rotated in an abrading direction and for disconnection of the one-way clutch with turning of the sleeve relative to the roller in a direction opposite to the abrading direction for removal of the sleeve from the roller; , wherein the portion of the one-way clutch comprises a sewing fleece.

16. An abrading sleeve in accordance with claim 15 wherein the portion of the one-way clutch located at the inner surface of the sleeve is a looped material such as the looped material used in a hook and loop fastener assembly which is sold under the trademark VELCRO or HOOK AND LOOP.

17. An abrading sleeve for detachably mounting on a rotatable roller, said abrading sleeve comprising:

a closed loop sleeve having a hollow interior bore;

an outer surface on the cylindrically-shaped sleeve having an abrasive material thereon;

an inner surface on the sleeve bore; and a portion of a one-way clutch located at the inner surface of the sleeve for driving connection with a clutch portion on the roller when the roller is rotated in an abrading direction and for disconnection of the one-way clutch with turning of the sleeve relative to the roller in a direction opposite to the abrading direction for removal of the sleeve from the roller; wherein the one-way clutch portion is a looped material to engage one-way teeth on the roller in order to drive the sleeve in the abrading direction.

* * * * *